United States Patent [19]

Boyars et al.

[11] 4,094,710

[45] June 13, 1978

[54] EXPLOSIVE COMPOSITION CONTAINING GUANIDINIUM PICRATE

[75] Inventors: Carl Boyars; Mortimer J. Kamlet, both of Silver Spring, Md.

[73] Assignee: The United States of America as represented by the Secretary of the Navy, Washington, D.C.

[21] Appl. No.: 390,443

[22] Filed: Aug. 16, 1973

[51] Int. Cl.[2] ..... C06B 45/18

[52] U.S. Cl. ..... 149/3; 149/4; 149/6; 149/8; 149/9; 149/10; 149/12

[58] Field of Search ..... 149/14, 4, 92, 6, 3, 149/8, 9, 10, 12

[56] References Cited

U.S. PATENT DOCUMENTS

| | | | |
|---|---|---|---|
| 1,939,365 | 12/1933 | Piccard | 149/14 X |
| 2,929,698 | 3/1960 | Audrieth et al. | 149/14 |
| 2,929,699 | 3/1960 | Audrieth et al. | 149/14 |

*Primary Examiner*—Stephen J. Lechert, Jr.

[57] ABSTRACT

An explosive composition with enhanced thermal stability and decreased impact sensitivity comprising an explosive material completely surrounded by a layer of guanidinium picrate.

8 Claims, No Drawings

EXPLOSIVE COMPOSITION CONTAINING GUANIDINIUM PICRATE

BACKGROUND OF THE INVENTION

This invention generally relates to explosive compositions and more particularly to explosive compositions containing guanidinium picrate.

Guanidinium picrate has been known to be an explosive composition for many years. Thus, in U.S. Pat. 1,558,565 guanidinium picrate is disclosed as being used an an explosive fill in a bomb. However, this compound has an unusually low heat of detonation so that it has not been used to any great extent. In fact, there are many explosives available today which have much greater heats of detonation and which release considerably more explosive energy upon detonation.

However, it has only recently been discovered that guanidinium picrate possesses certain properties which now make its use for certain applications advantageous. Thus, its extremely low sensitivity to impact, its low cost of production and excellent thermal stability can make the use of guanidinium picrate highly desirable for certain applications despite its low heat of detonation.

SUMMARY OF THE INVENTION

Accordingly, one object of this invention is to provide an explosive composition.

Another object of this invention is to provide an explosive composition that uses a relatively low cost material.

A further object of this invention is to provide an explosive composition which has good thermal stability.

A still further object of this invention is to provide an explosive composition which has relatively low sensitivity to impact.

These and other objects of this invention are accomplished by providing an explosive composition comprising a mass of explosive material completely encompassed or surrounded by a layer of guanidinium picrate.

DESCRIPTION OF THE PREFERRED EMBODIMENT

The explosive composition of this invention comprises an explosive mass completely encompassed or surrounded by a layer of guanidinium picrate. The guanidinium picrate comprises the outer layer of explosive since using it in this manner enables one to take advantage of certain of its properties and make it a useful explosive despite the low heat of detonation. Thus, the fact that guanidinium picrate is very insensitive to impact, (it survived the drop of the standard weight from 320 cm (the test machine limit) without detonation) means that the shock sensitivity of any explosive matter which is more sensitive than guanidinium picrate can be decreased by surrounding said explosive matter with a layer of guanidinium picrate. Similarly, the fact that guanidinium picrate has excellent thermal stability (less than 0.1cc of gas per gm per hr at 260° C and 4.0 at 300° C in the vacuum stability test) would increase the thermal stability of any composition which is less thermally stable if guanidinium picrate surrounds it. Thus, guanidinium picrate used as the outer layer of an explosive composition, such as in a bomb, would by virtue of its own excellent thermal stability and insulating ability reduce the hazard of accidental initiation by fires, aerodynamic heating or impact.

The general nature of the invention having been set forth, the following example is presented as a specific illustration thereof. It will be understood that the invention is not limited to this specific example but is susceptible to various modifications that will be recognized by one of ordinary skill in the art.

EXAMPLE

PREPARATION OF GUANIDINIUM PICRATE (I)

A mixture of picric acid in a solution of 350 ml of water and 50 ml of 28% $NH_4OH$ was heated to 60° C until the picric acid was dissolved. Then a solution of 20.0 grams of guanidinium carbonate in 100 ml of water was added to the hot picric acid solution, immediately forming a precipitate. The precipitate was collected on a fine sintered glass funnel and washed with methanol. The precipitate was then suspended in 3000 ml of water. The mixture was heated to 90° C to redissolve the precipitate and the resulting solution was filtered while still hot. The filtrate was cooled slowly overnight. Massive, thick, yellow-orange, needle-like crystals were formed. The crystals were washed first with methanol and then with diethyl ether. Finally, the crystals were dried at 110° C. The yield was 19.0 grams of guanidinium picrate (I) which decomposed at 325° C with very little prediscoloration.

Obviously, numerous modifications and variations of the present invention are possible in light of the above teachings. It is therefore to be understood that within the scope of the appended claims the invention may be practiced otherwise than as specifically described herein:

What is claimed as new and desired to be secured by Letters Patent of the U.S. is:

1. An explosive composition comprising a layer of guanidinium picrate completely surrounding an explosive material which is selected from the group consisting of (a) explosive materials having greater impact sensitivity than guanidinium picrate has, (b) explosive materials having lower thermal stability than guanidinium picrate has, and (c) mixtures thereof.

2. In an explosive composition having a greater impact sensitivity or a lower thermal stability than guanidinium picrate has, the improvement comprising completely surrounding said explosive composition with quanidinium picrate.

3. A method of increasing the thermal stability of explosive material which has a lower thermal stability than than guanidinium picrate has comprising completely surrounding said explosive material with a layer of guanidinium picrate.

4. A method of decreasing the impact sensitivity of explosive material having a greater impact sensitivity than guanidinium picrate has comprising completely surrounding said explosive material with guanidinium picrate.

5. The explosive composition of claim 1 wherein said explosive material has a greater impact sensitivity than guanidinium picrate has.

6. The explosive composition of claim 1 wherein said explosive material has a lower thermal stability than guanidinium picrate has.

7. The explosive composition of claim 2 wherein the explosive composition has a greater impact sensitivity than guanidinium picrate has.

8. The explosive composition of claim 2 wherein the explosive composition has a lower thermal stability than guanidinium picrate has.

* * * * *